US009326061B2

(12) United States Patent
Kim et al.

(10) Patent No.: US 9,326,061 B2
(45) Date of Patent: Apr. 26, 2016

(54) SOUND OUTPUT APPARATUS, AUDIO PROCESSING APPARATUS, SOUND OUTPUT METHOD, AND AUDIO PROCESSING METHOD

(71) Applicant: SAMSUNG ELECTRONICS CO., LTD., Suwon-si (KR)

(72) Inventors: Sung-yong Kim, Yongin-si (KR); Dae-kwang Kong, Gunpo-si (KR); Jak-heun Yang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 434 days.

(21) Appl. No.: 13/751,834

(22) Filed: Jan. 28, 2013

(65) Prior Publication Data

US 2013/0329891 A1 Dec. 12, 2013

(30) Foreign Application Priority Data

Jun. 8, 2012 (KR) ..... 10-2012-0061582

(51) Int. Cl.

| | |
|---|---|
| ***H04R 3/00*** | (2006.01) |
| ***H04R 5/02*** | (2006.01) |
| *H04S 7/00* | (2006.01) |

(52) U.S. Cl.

CPC .. *H04R 3/00* (2013.01); *H04R 5/02* (2013.01); *H04R 2420/07* (2013.01); *H04S 7/00* (2013.01)

(58) Field of Classification Search

None

See application file for complete search history.

(56) References Cited

U.S. PATENT DOCUMENTS

| | | | | |
|---|---|---|---|---|
| 8,340,330 | B2 * | 12/2012 | Yoon et al. | 381/307 |
| 2006/0132715 | A1 * | 6/2006 | Ho et al. | 353/15 |
| 2006/0153155 | A1 | 7/2006 | Jacobsen et al. | |
| 2007/0087686 | A1 | 4/2007 | Holm et al. | |
| 2008/0008338 | A1 | 1/2008 | Yoon et al. | |
| 2008/0205658 | A1 | 8/2008 | Breebaart | |
| 2009/0081948 | A1 | 3/2009 | Banks et al. | |
| 2009/0222116 | A1 | 9/2009 | Kang et al. | |
| 2010/0263603 | A1 | 10/2010 | Baron | |
| 2011/0150228 | A1 | 6/2011 | Yoon et al. | |

FOREIGN PATENT DOCUMENTS

| | | | |
|---|---|---|---|
| EP | 2 076 060 | A2 | 7/2009 |
| KR | 1020090094603 | A | 9/2009 |
| KR | 1020110072650 | A | 6/2011 |
| WO | 2005124764 | A1 | 12/2005 |
| WO | 2007/035021 | A1 | 3/2007 |

OTHER PUBLICATIONS

Communication dated Feb. 4, 2015 issued by the European Patent Office in counterpart Application No. 13160680.8.

BeoLab 3500-Guide, Apr. 1, 2007, XP055162174, 28 pgs. total.

(Continued)

*Primary Examiner* — Andrew L Sniezek

(74) *Attorney, Agent, or Firm* — Sughrue Mion, PLLC

(57) ABSTRACT

A sound output apparatus configured to connect to an audio processing apparatus may include a communication interface which receives an audio signal from the audio processing apparatus through a wireless communication; a speaker which outputs the received audio signal; an input unit which receives a user control command; and a controller which controls the communication interface so that the received control command is transmitted to the audio processing apparatus through the communication interface.

16 Claims, 7 Drawing Sheets

(56) References Cited

OTHER PUBLICATIONS

Michael Holzinger, "Canton your_World—Wireless HiFi System for iPod, PC and Mac", Sep. 6, 2011, XP055162276, 4 pgs. total.

Communication dated Jan. 20, 2016, issued by the European Patent Office in counterpart European Application No. 13160680.8.

Anonymous: "Dell AX510 Soundbar Speaker for Ultrasharp and Other Monitors with Pass Through Connector", Amazon.co.uk, Apr. 29, 2010, pp. 1-6, XP055240619, Retrieved Jan. 1, 2012 from the Internet: URL: http://www.amazon.co.uk/dp/B0043M5RA4?_encoding=UTF8&isInIframe=0&n=340831031&ref_=dp_prod-desc_0&s=computers&showDetailProductDesc=1#product-description_feature_div.

* cited by examiner

SOUND OUTPUT APPARATUS, AUDIO PROCESSING APPARATUS, SOUND OUTPUT METHOD, AND AUDIO PROCESSING METHOD

CROSS-REFERENCE TO RELATED APPLICATIONS

This application claims priority from Korean Patent Application No. 10-2012-0061582, filed Jun. 8, 2012 in the Korean Intellectual Property Office, the disclosure of which is incorporated herein in its entirety by reference.

BACKGROUND

1. Field

Apparatuses and methods consistent with the present disclosure relate to sound output apparatuses, audio processing apparatuses, sound output methods, and audio processing methods. More particularly, the present disclosure relates to a sound output apparatus, an audio processing apparatus, a sound output method, and an audio processing method provided to control the audio processing apparatus through the sound output apparatus and the audio processing apparatus signal-processes an input audio signal and transmits a signal-processed audio signal to the sound output apparatus.

2. Description of the Related Art

In order to improve space usability and portability of electronic devices, the electronic devices are becoming slimmer. Specifically, sound devices become thinner and are implemented in the form of a sound bar.

A related art sound device having the form of a sound bar is proposed in an all-in-one approach in which one sound device includes all components of the sound device. However, if all components are included in one sound device, the sound device needs to have various input-output terminals. As a result, the size to which the sound device may be slimmed down is limited.

In order to overcome these limitations, a front speaker of the sound device is implemented as a sound bar, and the sound device is implemented as a main set separated from the front speaker. In order to slim the front sound bar, an audio signal processing unit and an audio signal input-output unit are formed in the main set and the front sound bar receives a signal-processed audio signal from the main set using wires.

Connecting the front sound bar to the main set by wires has a negative visual effect due to the wires or cables and it is also difficult to manage the wires or cables.

SUMMARY

Exemplary embodiments overcome the above disadvantages and other disadvantages not described above. Exemplary embodiments provide a sound output apparatus, an audio processing apparatus, a sound output method and an audio processing method are provided to control the audio processing apparatus through the sound output apparatus and the audio processing apparatus signal-processes an input audio signal and transmits the signal-processed audio signal to the sound output apparatus.

According to an aspect of an exemplary embodiment, there is provided a sound output apparatus that is connected to an audio processing apparatus. The sound output apparatus may include a communication interface which receives an audio signal from the audio processing apparatus through a wireless communication; a speaker which outputs the received audio signal; an input unit which receives a user control command; and a controller which controls the communication interface so that the received control command is transmitted to the audio processing apparatus through the communication interface.

The sound output apparatus may include an amplifier which amplifies the received audio signal, and the speaker may output the amplified audio signal.

The input unit may include a plurality of buttons.

The input unit may receive the user control command from an external wireless remote control apparatus through a wireless communication.

The sound output apparatus may include an indicator which indicates the user command or information with respect to the received audio data.

The sound output apparatus may include a housing which surrounds the sound output apparatus and which forms a bar.

According to an aspect of another exemplary embodiment, there is provided an audio processing apparatus is connected to a sound output apparatus, the audio processing apparatus including an input-output unit which receives or outputs an audio signal; a communication interface which receives a control signal from the sound output apparatus through a wireless communication; and an audio processor which signal-processes the received audio signal and provides it to the communication interface.

The audio processing apparatus may include an amplifier which amplifies the signal processed audio data; and an audio output unit which outputs the amplified audio data.

The audio processor may divide the input audio signal among a plurality of channels, and may provide some of the divided channels to the communication interface unit, and may provide some of the divided channels to the amplifier.

The audio processing apparatus may include a controller. When the control signal is received from the sound output apparatus through the communication interface, the controller controls to signal-process the received audio signal based on the control signal, and to transmit the signal-processed audio signal through the communication interface.

According to an aspect of another exemplary embodiment, there is provided a sound output method of a sound output apparatus that is connected to an audio processing apparatus, the sound output method including receiving an audio signal from the audio processing apparatus through a wireless communication. The method further includes outputting the received audio signal, receiving a user control command, generating a control signal based on the received control command, and transmitting the control signal to the audio processing apparatus.

The sound output method may further include amplifying the received audio signal, and the outputting of the received audio signal may include outputting the audio signal amplified by the amplifying of the received audio signal.

The receiving of a user control command may include inputting the user control command by a plurality of buttons.

The receiving of the user control command may also include receiving of the user control command through a wireless communication.

The sound output method may include, after the receiving of a user control command, indicating the user control command or information with respect to the received audio signal.

The outputting of the received audio signal may include outputting the received audio signal in stereo through speakers which are spaced apart at a predetermined distance from each other.

According to an aspect of another exemplary embodiment, there is provided an audio processing method of an audio processing apparatus that is connected to a sound output apparatus. The method may include receiving or outputting an audio signal; receiving a control signal from the sound output apparatus through a wireless communication; and signal-processing the received audio signal and transmitting the signal-processed audio signal.

The audio processing method may include amplifying the signal-processed audio data and outputting the amplified audio data.

The transmitting of the signal-processed audio signal may include dividing the received audio signal among a plurality of channels, transmitting some of the divided channel, and providing some of the divided channels to an amplifier.

The audio processing method may further include, in response to the control signal received, signal-processing the received audio signal based on the control signal, and controlling to transmit the signal-processed audio signal to the sound output apparatus.

According to the various aspects of the exemplary embodiments, since a sound output apparatus which receives a user control command and generates a control signal is implemented separately from an audio processing apparatus which receives the control signal and performs input-output and signal processing of an audio signal, the sound output apparatus can be slimmer, and a user can directly control the sound output apparatus. Therefore, user convenience is improved.

BRIEF DESCRIPTION OF THE DRAWINGS

These and/or other aspects will become apparent by describing in detail exemplary embodiments, with reference to the accompanying drawings of which.

DETAILED DESCRIPTION OF THE EXEMPLARY EMBODIMENTS

Figure 1:
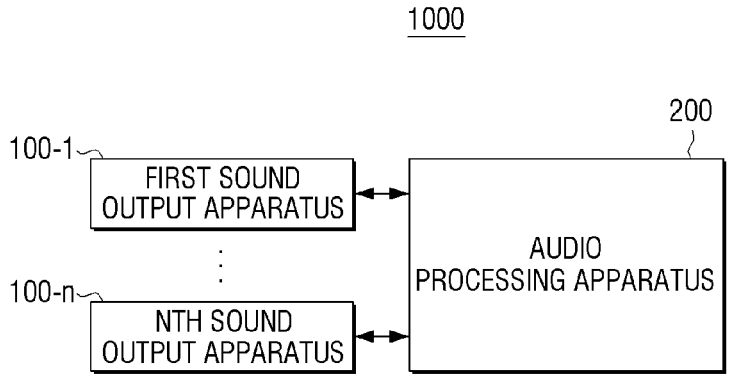
FIG. 1 is a block diagram illustrating a configuration of a plurality of sound output apparatuses and an audio processing apparatus according to an exemplary embodiment.

Hereinafter, certain exemplary embodiments will be described in more detail with reference to the accompanying drawings, in which exemplary embodiments are shown.

The matters defined herein, such as a detailed construction and elements thereof, are provided to assist in a comprehensive understanding of this description. Thus, it is apparent that exemplary embodiments may be carried out without those specifically defined matters. Also, functions or elements known in the related art are not described in detail to provide a clear and concise description of exemplary embodiments. Further, dimensions of various elements in the accompanying drawings may be arbitrarily increased or decreased for assisting in a comprehensive understanding. Throughout the drawings, like reference numerals will be understood to refer to like parts, components and structures.

FIG. 1 is a block diagram illustrating a configuration of a plurality of sound output apparatuses and an audio processing apparatus according to an exemplary embodiment.

Referring to FIG. 1, a sound output system 1000 according to an exemplary embodiment includes a plurality of sound output apparatuses 100-1 to **100-*n* and an audio processing apparatus 200**.

The plurality of sound output apparatuses 100-1 to **100-*n*** receives audio signals from the audio processing apparatus and outputs the audio signals.

The plurality of sound output apparatuses 100-1 to **100-*n* performs wireless data communication with the audio processing apparatus 200 to receive the audio signal. At least one of the plurality of sound output apparatuses 100-1 to 100-*n*** may have an input unit (or input device, not illustrated) which can input user control commands. The input unit may be implemented as an infrared (IR) type wireless control apparatus or may consist of a plurality of buttons and a touch pad provided on an outer surface of the sound output apparatus.

Accordingly, by controlling the sound output apparatus having the input unit (not illustrated), the user controls the audio processing apparatus 200 to signal-process an audio signal. In other words, the user uses the IR type wireless control apparatus to control the sound output apparatus, the sound output apparatus generates and transmits a control signal to the audio processing apparatus, and the audio processing apparatus is controlled by the control signal.

The sound output apparatus having the input unit may be implemented so that the user can send the control command through wireless communication to the audio processing apparatus either by using radio-frequency (RF) communication or by using IR communication.

When a user interface is implemented by using the IR communication, a separate IR type wireless control apparatus is provided and the sound output apparatus has an infrared (IR) receiver. The user controls the IR type wireless control apparatus so as to directly control the sound output apparatus, and, when a control signal is generated by the sound output apparatus, the sound output apparatus transmits the control signal to the audio processing apparatus, thereby controlling the audio processing apparatus.

When the user controls the sound output apparatus by the IR type wireless control apparatus, although the IR type wireless control apparatus with directivity is used, the user can control the audio processing apparatus to perform audio signal processing without orienting the wireless control apparatus toward the audio processing apparatus.

Figure 2:
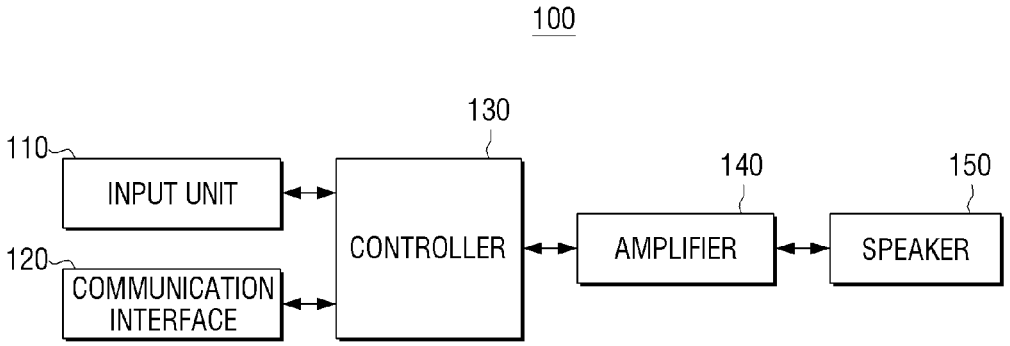
FIG. 2 is a block diagram illustrating a configuration of a sound output apparatus according to an exemplary embodiment.

FIG. 2 is a block diagram illustrating a configuration of a sound output apparatus according to an exemplary embodiment.

Referring to FIG. 2, the sound output apparatus according to an exemplary embodiment includes an input unit 110, a communication interface 120, a controller 130, an amplifier 140 and a speaker (or an audio output unit) 150.

The input unit 110 may be implemented by a plurality of buttons, a touch pad, a touch screen, etc., which can receive control commands from the user. The user can input various control commands related to the sound of the sound output apparatus 100 through the input unit 110. In other words, when the input unit 110 is implemented with the touch screen, the user can input a specific control command by touching a surface of the input unit 110.

According to another exemplary embodiment, the input unit 110 may be implemented as an infrared (IR) type wireless remote controller. In this case, the sound output apparatus 100 includes an infrared (IR) signal receiver, and the infrared type wireless remote controller may be implemented as a separate device independent from the sound output apparatus 100. The wireless remote controller includes a plurality of buttons, the user presses and touches the plurality of buttons to input user commands, and the input user commands are converted into infrared (IR) signals and transmitted to the IR signal receiver provided in the sound output apparatus 100.

The communication interface 120 provides wireless data communication between the sound output apparatus 100 and the audio processing apparatus 200. In other words, the communication interface 120 transmits control signals with respect to the user control commands that are input through the input unit 110 to the audio processing apparatus 200. For example, the communication interface 120 may be implemented as various types such as a wireless local area network (LAN), a radio frequency (RF) interface, a Bluetooth interface, etc. The communication interface 120 allows a wireless type data transfer to be performed between the sound output apparatus 100 and the audio processing apparatus 200.

The controller 130 generates control signals for controlling overall behaviors of the sound output apparatus 100 based on the user control commands input by the input unit 110. In other words, the controller 130 analyzes the user control commands which are input through the input unit 110 and generates control signals corresponding to the control commands.

The control device 130 can switch the audio signal which is received from the audio processing apparatus 200 through the communication interface 120 to the amplifier 140. The controller 130 can transmit the control signal to the audio processing apparatus 200 to redo signal-processing with respect to the received audio signal and to transmit the signal-processed audio signal based on the control command of the user.

In other words, the controller 130 generates a control signal for the sound output apparatus 100 to receive the audio signal from the audio processing apparatus 200. The controller 130 transmits the control signal to the audio processing apparatus 200 through the communication interface 120. When the user inputs a separate control command with respect to the audio signal output by the sound output apparatus 100, the sound output apparatus 100 controls the audio processing apparatus 200 based on the input control command so as to receive and output the audio signal that corresponds to the control command of the user.

The amplifier 140 increases or reduces the size of the waveform of the audio signal received through the communication interface 120 to a predetermined size. The amplifier 140 may be configured as at least one amplifier.

The speaker 150 may be configured as a plurality of speakers. The speaker 150 may include a plurality of speakers which are spaced apart at a predetermined distance from each other. For example, when the speaker 150 is a stereo speaker, the speaker includes two speakers. Alternatively, the speaker 150 may include two or more speakers. The speaker 150 may be configured so that a first speaker and a second speaker are spaced apart at a predetermined distance from each other.

The sound output apparatus 100 may be included within a bar-shaped housing. The bar shaped sound output apparatus 100 includes a plurality of openings through which the speaker 150 is exposed on a surface of the output apparatus 100. The plurality of openings of the sound output apparatus 100 is formed to be spaced apart at a predetermined distance from each other. The specific outer appearance of the sound output apparatus 100 will now be explained in more detail.

Figure 3:
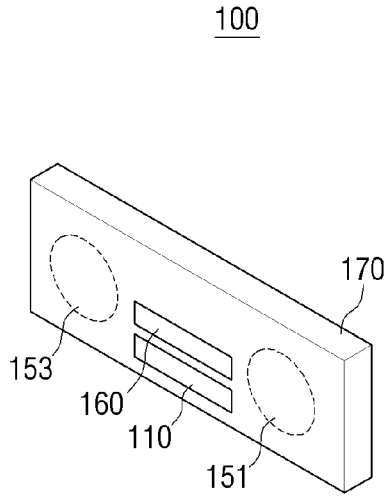
FIG. 3 is a view illustrating an outer appearance of a soundbar shaped sound output apparatus according to an exemplary embodiment.

FIG. 3 is a view illustrating an outer appearance of a sound bar-shaped sound output apparatus according to an exemplary embodiment.

Referring to FIG. 3, the bar-shaped sound output apparatus 100 includes the configuration of the sound output apparatus as illustrated in FIG. 2 within a housing 170 in the form of a rectangular shape.

The housing 170 includes the input unit 110, the speaker 151 and 153, and an indicator 160 on a surface of the housing.

The input unit 110 may also be implemented on the surface of the housing 170 in the form of a key pad having a plurality of buttons as described above. Alternatively, the input unit 110 may be implemented as a separate IR wireless control apparatus and an IR receiver to perform IR communication.

Although the communication interface 120, the controller 130 and the amplifier 140 are not illustrated in FIG. 3, they are included within the housing 170. They are explained in detail with respect to FIG. 2; therefore, detail explanations of the communication interface 120, the controller 130 and the amplifier 140 are omitted with respect to the description of FIG. 3.

The speaker 151 and 153 consists of a first speaker 151 and a second speaker 153. The speaker 151 and 153 is formed to be spaced apart at a predetermined distance from each other on the surface of the bar-shaped housing 170.

The indicator 160 indicates the control command of the user or information with respect to the received audio signal. The indicator 160 may be configured of LED lamps or indicators which express status information indicating whether the audio signal or identification information are received according to the type of the control commands.

Since the sound output apparatus 100 according to the present disclosure includes the input unit 110, the communication interface 120, the controller 130, the amplifier 140, and the speaker 150 within the bar-shaped housing 170, a slim sound bar-shaped sound output apparatus can be implemented.

Specifically, the sound output apparatus 100 according to the exemplary embodiment receives wirelessly user control commands through the input unit 110, and receives the signal-processed audio signal through the communication interface 120. The sound output apparatus 100 according to the present disclosure does not include input-output terminals but receives the audio signal from the audio processing apparatus 200 through wireless communication. Also, since the input unit is provided with the sound output apparatus 100, even when the user instinctively controls the sound output apparatus 100, the audio processing apparatus 200 can be simultaneously controlled; therefore, user convenience may be improved.

Figure 4:
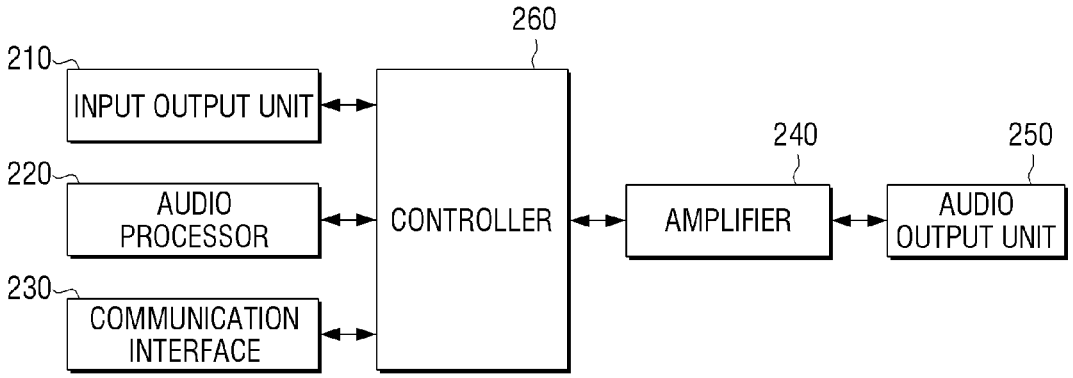
FIG. 4 is a view illustrating an audio processing apparatus according to an exemplary embodiment.

FIG. 4 is a view illustrating an audio processing apparatus according to an exemplary embodiment.

Referring to FIG. 4, an audio processing apparatus 200 according to an exemplary embodiment includes an input-output unit 210, an audio processor 220, a communication interface 230, an amplifier 240, an audio output unit 250, and a controller 260.

The input-output unit 210 includes a plurality of input terminals or output terminals for inputting or outputting a plurality of audio signals. The input-output unit 210 consists of an input terminal which can receive the audio signal and an output terminal which can output the audio signal.

The input-output unit 210 functions as an audio input output interface. For example, the input output unit 210 can receive and output the audio signal through a wired communication using a USB interface, an IEEE 1394 interface, an AUX interface, an HDMI interface, etc. Also, the input output unit 210 can receive and output various audio signals through a wireless communication using a Bluetooth interface, a radio frequency RF interface, a FM tuner interface, etc.

The audio processor 220 performs A/D conversion to convert the plurality of audio signals input through the input output unit 210 into digital audio signals, and changes amplitudes, bit rates, etc., of the converted digital audio signals.

Also, the audio processor 220 performs signal processing with respect to the digital audio signal based on the control signal received from the sound output apparatus 100. For example, the audio processor 220 performs the signal processing with respect to the digital audio signal according to a user command such as fast forward, rewind, quick play, play, etc., of the audio signal.

Also, the audio processor 220 performs the signal processing such as up-mixing, down-mixing, and bypassing based on the number of channels that can be supported by the sound output apparatus 100.

The communication interface 230, provides data communication between the sound output apparatus 100 and the audio processing apparatus 200 through wireless communication. In other words, the communication interface 230 wirelessly transmits the audio signal which is signal-processed by the audio processor 220 to the sound output apparatus 100. For example, the communication interface 230 may be implemented in various ways such as a wireless LAN interface, a radio frequency (RF) interface, a Bluetooth interface, etc. The communication interface 230 provides a wireless communication interface between the sound output apparatus 100 and the audio processing apparatus 200.

The amplifier 240 increases or reduces the amplitude of the audio signal which is signal-processed by the audio processor 220, thereby amplifying or reducing the audio signal. The amplifier 240 may be configured as at least one amplifier.

The audio output unit 250 may consist of a plurality of speakers. The plurality of speakers may be spaced apart at a predetermined distance from each other. For example, when the audio output unit 250 is a stereo speaker, the speaker includes two speakers. Alternatively, the audio output unit 250 may include two or more speakers.

The controller 260 receives the control signal from the sound output apparatus 100 through the communication interface 230, and controls the audio processor 220 to perform signal processing of the input audio signal based on the control signal.

The controller 260 controls the communication interface 230 to transmit the signal-processed audio signal to the sound output apparatus 100. In addition, the controller 260 generates command signals to control the overall behavior of the audio output apparatus 200.

Figure 5:
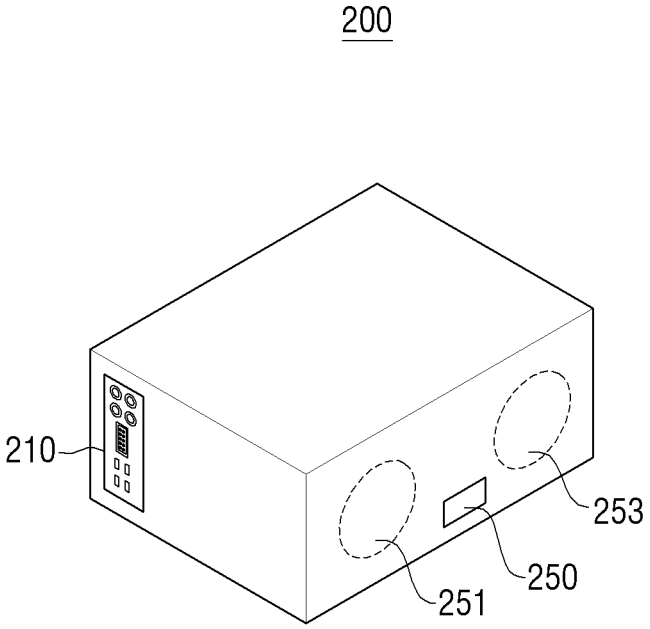
FIG. 5 is a view illustrating an outer appearance of an audio processing apparatus according to an exemplary embodiment.

FIG. 5 is a view illustrating an outer appearance of an audio processing apparatus according to an exemplary embodiment.

Referring to FIG. 5, the audio processing apparatus 200 according to an exemplary embodiment includes the configuration of the audio processing apparatus 200 as illustrated in FIG. 4 within a box-shaped housing. More specifically, the audio processing apparatus 200 is included within a housing 270 in the form of a rectangular parallelepiped box. The audio processing apparatus 200 has an audio output unit 251 and 253 on a front surface of the audio processing apparatus and an input output unit 210 on a side surface of the audio processing apparatus.

The input output unit 210 includes various types of audio input output terminals. For example, the input output unit 210 includes USB terminals, HDMI terminals, IEEE 1394 terminals, audio jack terminals, microphone jack terminals, etc. According to an exemplary embodiment, since various input output units 210 are provided on the side surface of the audio processing apparatus 200, a wide range of interfaces of various audio devices are available.

Also, the sound bar-shaped sound output apparatus 100 does not have the input output unit 210, and the audio processing apparatus 200 signal-processes the input audio signal.

According to an exemplary embodiment, the sound output apparatus 100 and the audio processing apparatus 200 are designed to share and manage functions with each other. Due to this feature, the sound output apparatus 100 can be implemented in a slim sound bar shape. The slim type sound output apparatus 100 can perform wireless communication with the audio processing apparatus 200, and when the user controls the sound output apparatus 100, the audio processing apparatus 200 can be simultaneously controlled.

Since the sound output apparatus 100 is implemented physically separate from the audio processing apparatus 200, the sound output apparatus 100 can be formed with a thinner thickness. Also, since the sound output apparatus 100 is implemented in an ultra-slim shape, the slim sound output apparatus 100 can be disposed on at least one of a side surface, a bottom surface, and a top surface of a display apparatus (not illustrated). Therefore, an audio output of the slim display apparatus can be enhanced.

Also, since the slim sound output apparatus 100 is attached adjacent to the display apparatus, if the user controls the sound output apparatus 100 while looking at the display apparatus, the audio processing apparatus 200 can be simultaneously controlled.

Although the audio output unit 251 and 253 is illustrated in FIG. 4 to have two speakers, the audio output unit may include two or more speakers.

Figure 6:
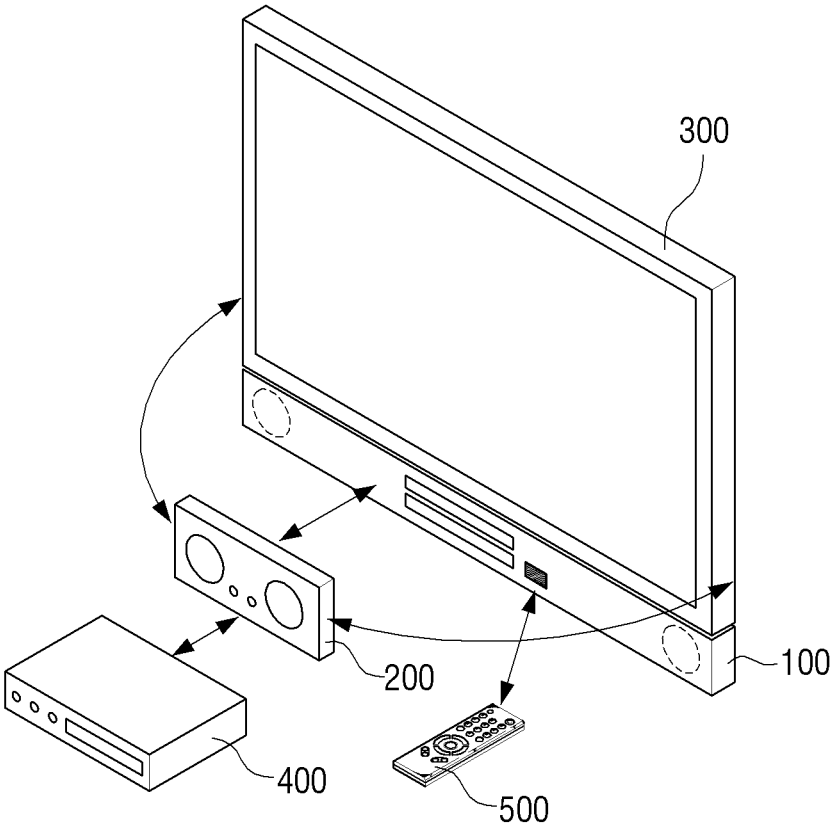
FIG. 6 is a view illustrating a sound output system according to an exemplary embodiment.

FIG. 6 is a view illustrating a sound output system according to an exemplary embodiment.

Referring to FIG. 6, a sound output system 1000 includes the sound output apparatus 100, the audio processing apparatus 200, the display apparatus 300, a content supply apparatus 400 and a wireless remote control apparatus 500.

The sound output apparatus 100 is configured in the form of a sound bar, and may be arranged at a position adjacent to a bottom surface of the display apparatus 300. The sound output apparatus 100 is configured to be separate from built-in speakers of the display apparatus 300.

The sound output apparatus 100 receives the audio signal from the audio processing apparatus 200 through wireless communication. The wireless communication interface by which the sound output apparatus 100 receives the audio signal from the audio processing apparatus 200 may be implemented as a RF interface, a wireless LAN interface, a Bluetooth interface, etc.

Also, the sound output apparatus 100 receives control commands of the user through wireless communication. The wireless communication interface by which the sound output apparatus 100 receives the control commands from the user may be implemented as an IR interface. In other words, the user can input the control commands into the sound output apparatus 100 through the IR wireless remote control apparatus 500. When the control commands are transmitted through the IR interface, the control commands have directivity due to the characteristic of the IR signal. Therefore, the user operates the IR wireless remote control apparatus 500 in a direction of the IR receiver of the sound output apparatus 100.

However, since the slim sound output apparatus 100 according to the present disclosure is disposed at a position adjacent to the display apparatus 300, if the IR wireless control apparatus 500 is directed toward the display apparatus 300, the sound output apparatus 100 can be easily controlled.

The audio processing apparatus 200 receives a plurality of audio signals from the content supply apparatus 400 and performs signal processing with respect to the input audio signals based on the control command. The audio processing apparatus 200 supplies the signal-processed audio signals to the sound output apparatus 100 and the display apparatus 300. The audio processing apparatus 200 can output the signal-processed audio signals by itself.

Figure 7:
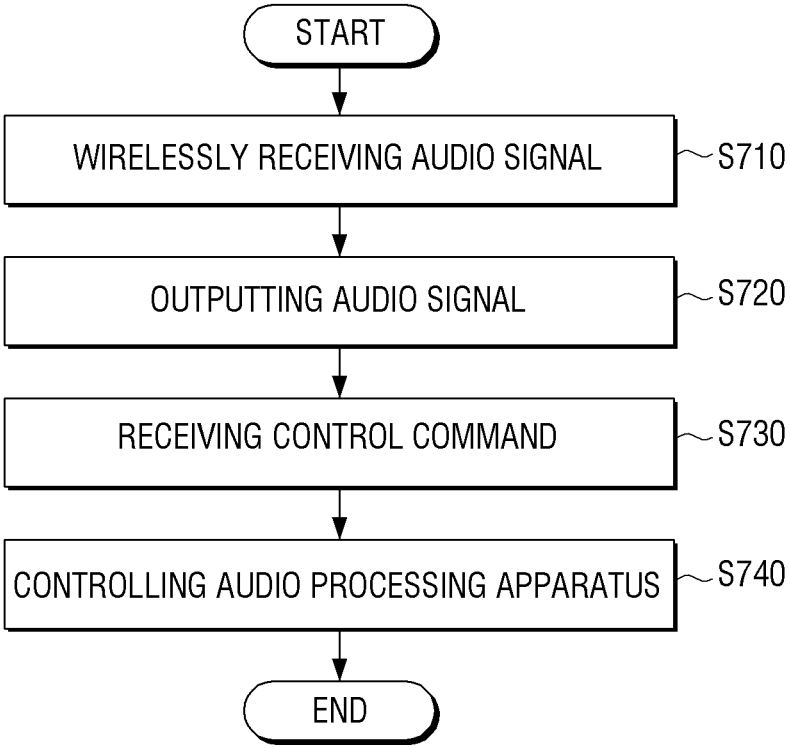
FIG. 7 is a flowchart illustrating a sound output method according to an exemplary embodiment.

FIG. 7 is a flowchart illustrating a sound output method according to an exemplary embodiment.

Referring to FIG. 7, the sound output method includes receiving an audio signal (S710), outputting the audio signal (S720), receiving a control command (S730), and controlling the audio processing apparatus (S740).

The operation of receiving an audio signal includes receiving the signal-processed audio signal. That is, the received audio signal is an audio signal that was signal-processed by a separate audio processing method according to the control command. The audio data are received through a wireless communication during the operation of the receiving the audio signal. The wireless communication can include using an RF interface, a Bluetooth interface, a wireless LAN interface, etc., and as long as it is a wireless communication, any wireless communication can be applied to and the wireless communication is not limited to a specific wireless communication (S710).

The operation of outputting the audio signal includes directly outputting the received audio signal without performing a separate signal processing operation. However, an operation of amplifying or reducing the audio signal for enlarging or reducing the size of the amplitude of the received audio signal may be further performed. After the size of the amplitude is converted, the audio signal is output (S720).

The operation of receiving a control command includes inputting the control command by a user through a wireless communication. In other words, the user can input the control command through the wireless remote control apparatus, and an interface though which the control command is input may be an IR interface. However, in addition to the IR interface, the interface may be implemented as a RF interface or a Bluetooth interface. The IR interface includes a small amount of data to be transmitted, so it may be applied to perform simple control behavior. Accordingly, in the sound output method according to the exemplary embodiment the control command is received from the user through the IR interface of the wireless control apparatus. Also, the user can directly input the control command through a user interface provided on the sound output apparatus (S730).

The operation of controlling the audio processing apparatus includes converting the control command input by the user into a control signal and transmitting the converted control signal to the audio processing apparatus through wireless communication. After the control signal is transmitted to the audio processing apparatus, based on the control signal the audio processing apparatus performs signal processing with respect to the input audio signal (S740).

Figure 8:
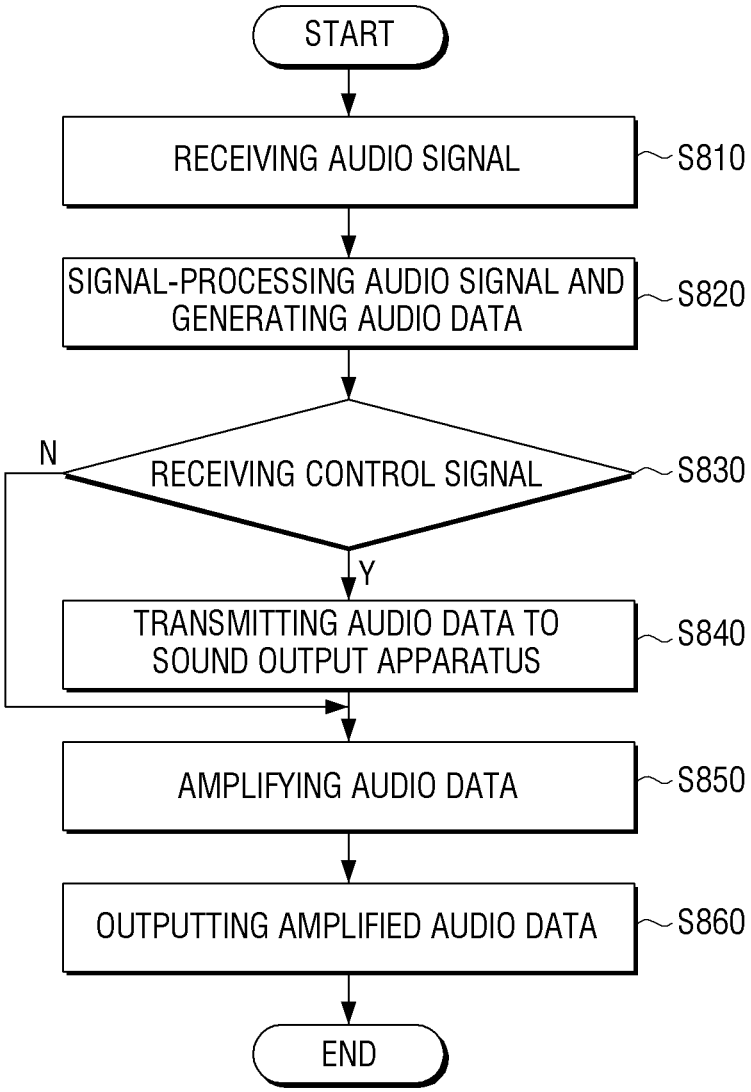
FIG. 8 is a flowchart illustrating an audio processing method according to an exemplary embodiment.

FIG. 8 is a flowchart illustrating an audio processing method according to an exemplary embodiment.

Referring to FIG. 8, a plurality of audio signals is received from various audio sources (S810). The input audio signal is signal-processed to generate a digital audio data (S820). When a control command is input by the user (S830-Y) and a control signal based on the control command is received, the input audio signal is signal-processed based on the control signal. The signal-processed audio signal is transmitted to the sound output apparatus (S840).

If the control command is not input by the user (S830-N), the signal-processed audio data are amplified (S850) and the amplified audio data is output (S860).

Figure 9:
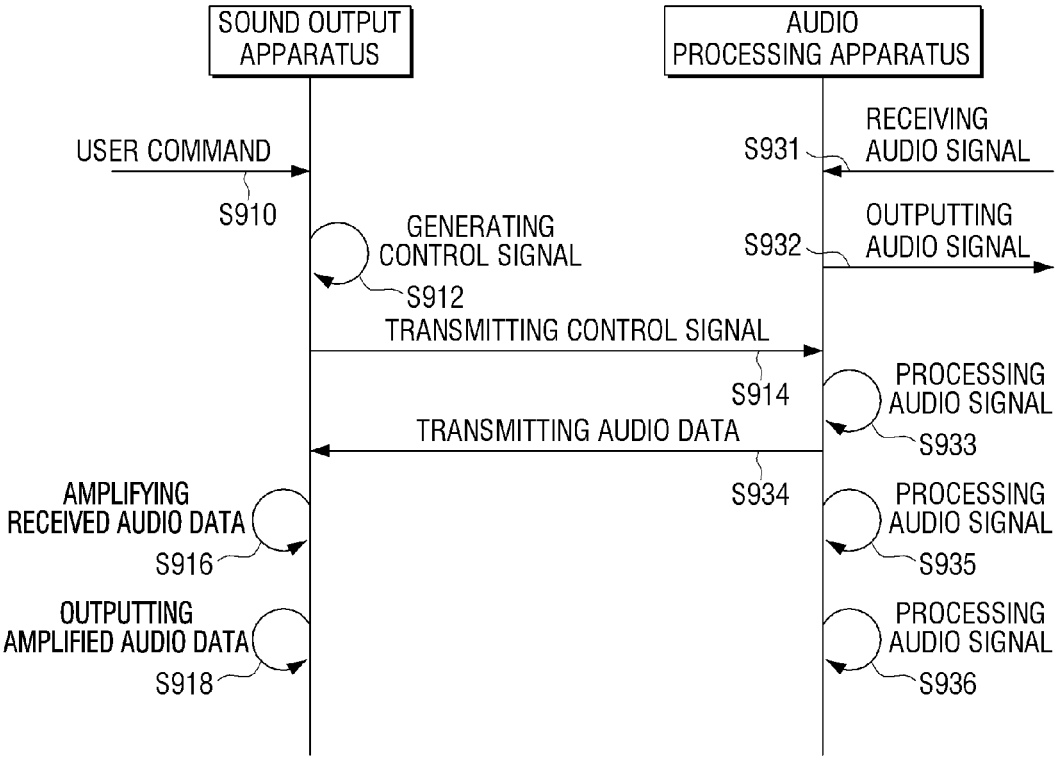
FIG. 9 is a view illustrating signal flows between an audio processing apparatus and a sound output apparatus according to an exemplary embodiment.

FIG. 9 is a view illustrating signal flows between an audio processing apparatus and a sound output apparatus according to an exemplary embodiment.

Referring to FIG. 9, firstly, the user inputs a user control command into the sound output apparatus 100 through a remote control apparatus (S910).

The sound output apparatus 100 generates a control signal based on the user control command (S912). The sound output apparatus 100 wirelessly transmits the control signal to the audio processing apparatus 200 (S914).

The audio processing apparatus 200 can receive an audio signal (S931) or output the audio signal (S932) based on the received control signal. Also, the audio processing apparatus 200 signal-processes the pre-input audio signal based on the control signal (S933). The audio processing apparatus 200 transmits the signal-processed audio data signal to the sound output apparatus 100 (S934).

The sound output apparatus 100 amplifies the received audio data (S916). The sound output apparatus 100 outputs the amplified audio data through at least one speaker (S918).

After transmitting the signal-processed audio signal to the sound output apparatus 100, the audio processing apparatus 200 amplifies the audio data (S935). The audio processing apparatus 200 outputs the amplified audio data through at least one speaker (S936).

The foregoing exemplary embodiments and advantages are merely exemplary and are not to be construed as limiting the present inventive concept. The exemplary embodiments can be readily applied to other types of apparatuses and methods. The description of the exemplary embodiments is intended to be illustrative, and not to limit the scope of the claims, and many alternatives, modifications, and variations will be apparent to those skilled in the art.

What is claimed is:

1. A sound output apparatus configured to connect to an audio processing apparatus, the sound output apparatus comprising:

a communication interface configured to receive an audio signal from the audio processing apparatus through a wireless communication;

a plurality of speakers configured to be spaced apart at a predetermined distance from each other and output the received audio signal in stereo;

an input unit configured to receive a user control command; and a controller configured to control the communication interface so that the received user control command is transmitted to the audio processing apparatus through a wireless communication to control signal processing in the audio processing apparatus, wherein the sound output apparatus has a bar shape including the plurality of speakers and is attachable or detachable to an electronic apparatus by the bar shape.

2. The sound output apparatus of claim 1, further comprising:

an amplifier configured to amplify the received audio signal, wherein the plurality of speakers is configured to output the amplified audio signal.

3. The sound output apparatus of claim 1, wherein the input unit comprises a plurality of buttons.

4. The sound output apparatus of claim 1, wherein the input unit is configured to receive the user control command from an external wireless remote control apparatus through a wireless communication.

5. The sound output apparatus of claim 1, further comprising:

a housing which is configured to surround the sound output apparatus and to form a bar.

6. The sound output apparatus of claim 5, further comprising:

an indicator which is disposed on an outer surface of the housing and configured to indicate the user control command or information with respect to the received audio signal.

7. The sound output apparatus of claim 5, wherein the housing is configured to be arranged at a position adjacent to a bottom surface of a display apparatus.

8. The sound output apparatus of claim 1, wherein the input unit comprises an infrared receiver configured to receive a user control command that is converted into infrared signals, and the communication interface comprises at least one of a wireless local area network (LAN), a radio frequency (RF) interface and a Bluetooth interface.

9. The sound output apparatus of claim 1, wherein the audio signal received from the audio processing apparatus is a signal-processed digital signal.

10. The sound output apparatus of claim 1, wherein the audio signal received from the audio processing apparatus is a signal-processed audio signal that is different from an audio signal before the signal-processing in amplitude or bit rate.

11. The sound output apparatus of claim 1, wherein the audio signal received from the audio processing apparatus is a signal-processed audio signal that is an up-mixed or a down-mixed or a bypassed audio signal based on a number of channels that is supported by the sound output apparatus.

12. A sound output method of a sound output apparatus configured to connect to an audio processing apparatus, the sound output method comprising:

receiving an audio signal from the audio processing apparatus through a wireless communication;

outputting the received audio signal in stereo through a plurality of speakers which are spaced apart at a predetermined distance from each other;

receiving a user control command;

generating a control signal based on the received user control command; and transmitting the control signal to the audio processing apparatus through a wireless communication to control signal processing in the audio processing apparatus, wherein the sound output apparatus has a bar shape including the plurality of speakers and is attachable or detachable to an electronic apparatus by the bar shape.

13. The sound output method of claim 12, further comprising:

amplifying the received audio signal;

wherein the outputting the received audio signal comprises outputting of the audio signal amplified by the amplifying of the received audio signal.

14. The sound output method of claim 13, wherein the receiving of the user control command comprises inputting the user control command by a plurality of buttons.

15. The sound output method of claim 13, wherein the receiving of the user control command comprises receiving the user control command through the wireless communication.

16. The sound output method of claim 12, further comprising:

after the receiving of the user control command, indicating the user control command or information with respect to the received audio signal.

* * * * *